US006155031A

United States Patent [19]

Ballestrazzi et al.

[11] Patent Number: 6,155,031

[45] Date of Patent: Dec. 5, 2000

[54] MODULAR AUTOMATIC ENVELOPE INSERTING MACHINE

[75] Inventors: Aris Ballestrazzi; Lamberto Tassi, both of Savignano sul Panaro, Italy

[73] Assignee: Sitma S.p.A., Spilamberto, Italy

[21] Appl. No.: 09/268,727

[22] Filed: Mar. 17, 1999

[30] Foreign Application Priority Data

Mar. 24, 1998 [IT] Italy ..... MI98A0596
Apr. 16, 1998 [IT] Italy ..... M1980271 U

[51] Int. Cl.[7] ..... B65B 43/26

[52] U.S. Cl. ..... 53/569; 53/381.5; 53/381.6

[58] Field of Search ..... 53/492, 381.5, 53/381.1, 381.6, 569

[56] References Cited

U.S. PATENT DOCUMENTS

| | | | |
|---|---|---|---|
| 4,852,334 | 8/1989 | Auerbach | 53/381.5 |
| 5,414,977 | 5/1995 | Cohen | 53/381.5 |
| 5,447,015 | 9/1995 | Belec et al. | 53/381.6 |
| 5,618,375 | 4/1997 | Suzuki | 53/381.5 |
| 5,651,238 | 7/1997 | Belec et al. | 53/381.6 |
| 5,660,030 | 8/1997 | Auerbach et al. | 53/381.5 |
| 5,706,636 | 1/1998 | Eckl | 53/381.5 |
| 5,809,749 | 9/1998 | Ruggiero et al. | 53/381.5 |

*Primary Examiner*—Eugene Kim
*Attorney, Agent, or Firm*—Oblon, Spivak, McClelland, Maier & Neustadt, P.C.

[57] ABSTRACT

An automatic envelope inserting machine which comprises a supporting structure (31, 331) whereon envelopes (17) are made to feed, in said envelopes one or more flat inserts have to be placed (16, 16', 16"), an envelope feeder (18, 318) towards a conveyor belt (15, 40, 40*a*, 315, 340, 340*a*) which carries one envelope behind the other, at least one insert loader (11–14, 211, 212), an insertion device of at least one insert, which is selected and directed towards the feed conveyor belt, and which is inserted into a predetermined envelope (17) and elements (87) for the opening of the envelope (17), whereby, before the envelope feeder (18, 318), a deviation device (19) is provided to carry the selected inserts towards the insertion device (20, 84, 320, 384), the insertion device can move back and forth with respect to the supporting structure (31, 331), by means of translation elements (44), in a direction parallel to the feed conveyor belt and synchronised with the forward movement of the envelope (17), a pushing device (84) is provided at one end of the deviation device (19) in order to carry the insert to the insertion device (20).

9 Claims, 12 Drawing Sheets

MODULAR AUTOMATIC ENVELOPE INSERTING MACHINE

Figure 1:
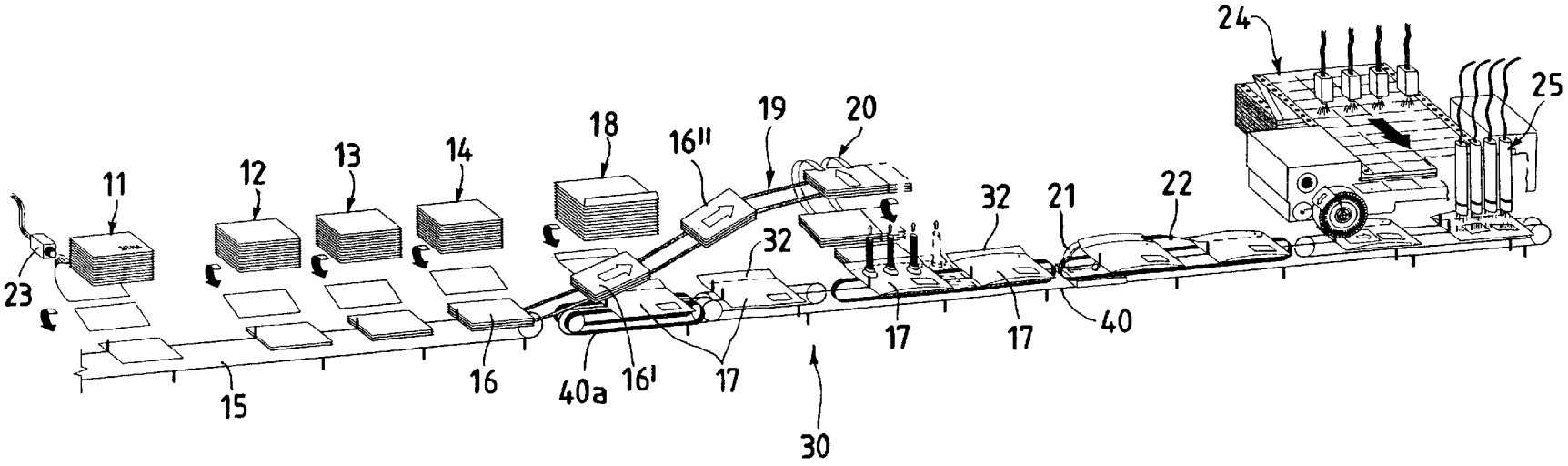

The present invention refers to a modular automatic envelope inserting machine.

In the industry of machines for handling envelopes and letters, there are envelope machines that receive, on a first conveyor belt, from a series of sheet feeders, an insert or a series of inserts to be put into an envelope, and, on a second conveyor belt, the envelopes wherein the insert or the inserts are inserted. The two conveyor belts run parallel to each other towards the area where the insertion takes place.

In fact, at the station provided for the envelope insertion, the two conveyor belts stop and the single insert or the inserts, stacked and gathered together on the first conveyor belt, are transferred by means of a pushing device into the envelope, which is in a standstill, side by side position on the other conveyor belt.

On this occasion, the envelope is opened by grasping means provided with suction cups or vacuum operated in order to facilitate the insertion. Only when the insert or inserts have been introduced into the envelope the conveyor belts can continue their run and can repeat the entire operation for the following envelope and inserts. These start and stop stages with alternate movement when inserting the envelopes cause problems on the vertical alignment of the stack and on the formation of the insert stacks. This causes a serious inconvenience for the correct insertion into the envelopes, which can result difficult because of hindrances or can determine the tearing of an envelope and the consequent standstill of the entire envelope inserting machine. To minimise the vertical division of the insert stacks, the envelope inserting machine must work at low speed.

Furthermore, in general, to facilitate such insertion operation, the envelope is made to move forward on its conveyor belt with its opening turned towards the parallel insert conveyor belt, with the sealing flap open and with the address or windowed surface facing down.

At this point, the envelope is further rotated by 180° so that the surface with the address or with the address window is facing up, therefore facilitating either the reading of the address through the envelope window, or the application of the pre-printed label, or the printing of the address, or other checking operations that otherwise could not be realised.

A purpose of this invention is therefore to carry out an automatic envelope inserting machine capable of inserting the inserts into an envelope without the inserts or the envelope being stopped during the insertion stage.

A further purpose of this invention is to carry out an automatic envelope inserting machine that eliminates any need of stopping and that carries out the insertion of the inserts into the envelope whilst working continuously, during the feeding stage without stopping at all.

Another purpose of this invention is to carry out an automatic envelope inserting machine having a high productivity and optimising the work space.

Another purpose is to eliminate any possible, even minimum, time lost during the continuous insertion into the envelopes.

Another purpose is to carry out an automatic envelope inserting machine that eliminates possible blocks between the envelope and the insert stack, due to the incorrect stacking of the inserts, caused by the intermittent movement of the feeding.

Another purpose is to carry out an automatic envelope inserting machine that works continuously and that allows the increase of the speed of insertion, with a significant reduction in time and in management costs.

A further purpose is to carry out a modular automatic envelope inserting machine that can possibly be inserted in a packaging line taking advantage of the sheet feeders available in said line and therefore reducing the plant costs.

These purposes, according to the present invention, are achieved by carrying out an envelope inserting machine which comprises a supporting structure whereon envelopes are made to advance, in said envelopes one or more flat inserts have to be placed, an envelope feeder which feeds, towards a feed conveyor belt, one envelope after the other, at least one insert loader, an insertion device of at least one insert, which is selected and directed towards the feed conveyor belt, and which is inserted into a predetermined envelope and elements for the opening of the envelope, characterised in that, before the envelope feeder, a deviation device is provided to carry at least one of said selected inserts towards said insertion device, said insertion device can move back and forth with respect to said supporting structure, by means of translation elements, in a direction parallel to said feed conveyor belt and in phase with the envelope feed, a pushing device is provided at one end of said deviation device, which carries at least one of said inserts, to transport at least one of said inserts from said deviation device to said insertion device.

Figure 2:
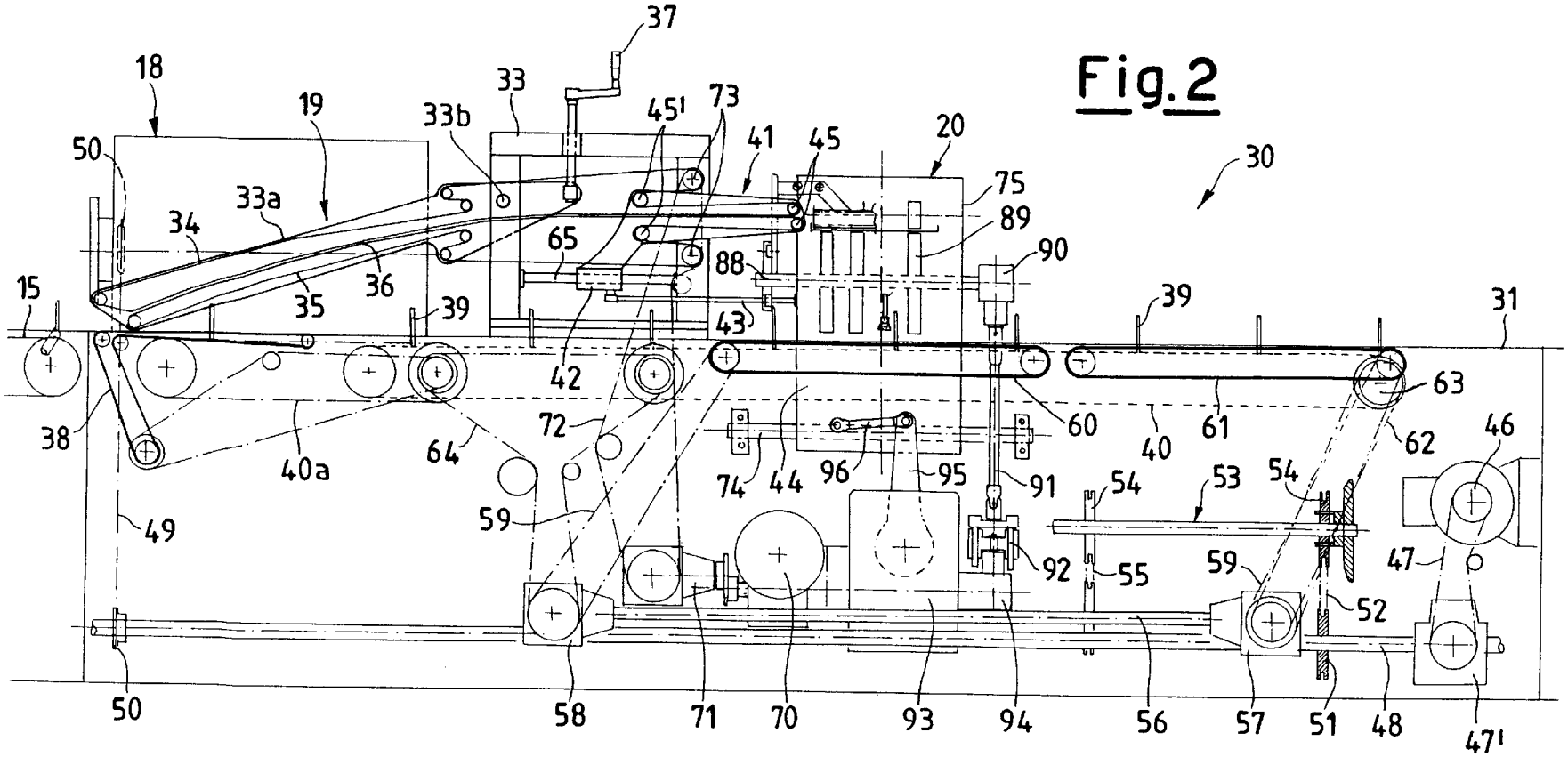
Figure 3:
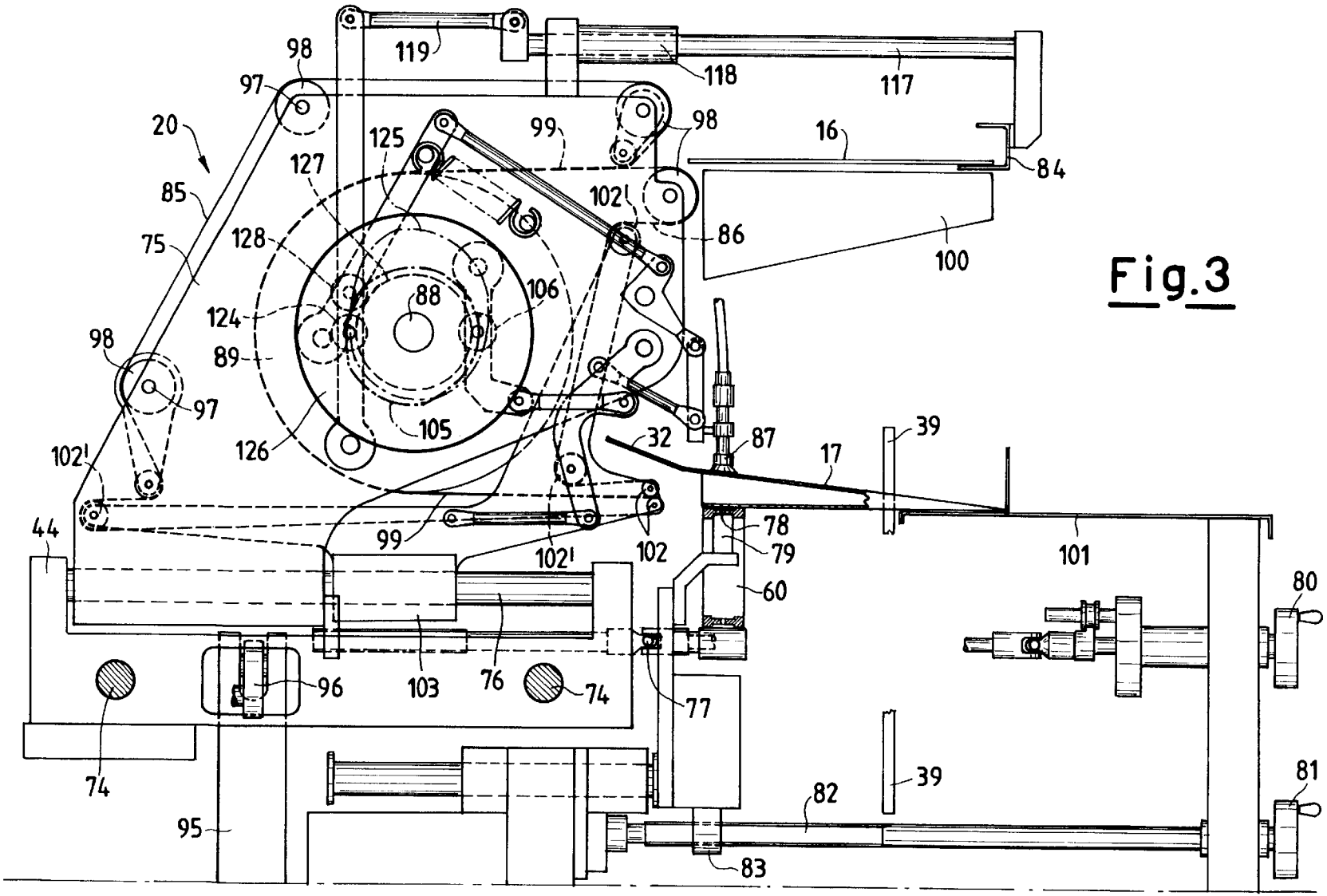
Figure 4:
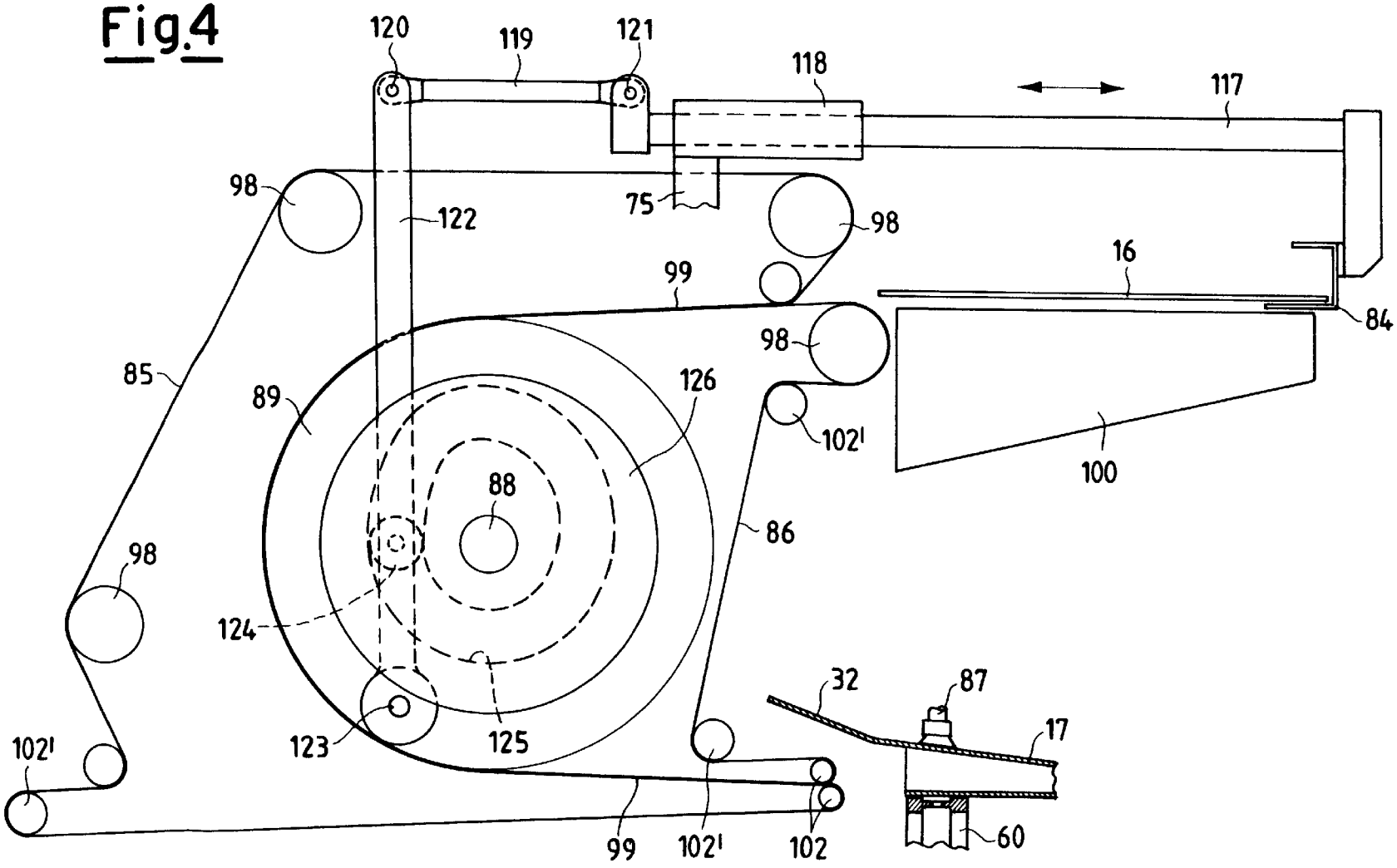
Figure 5:
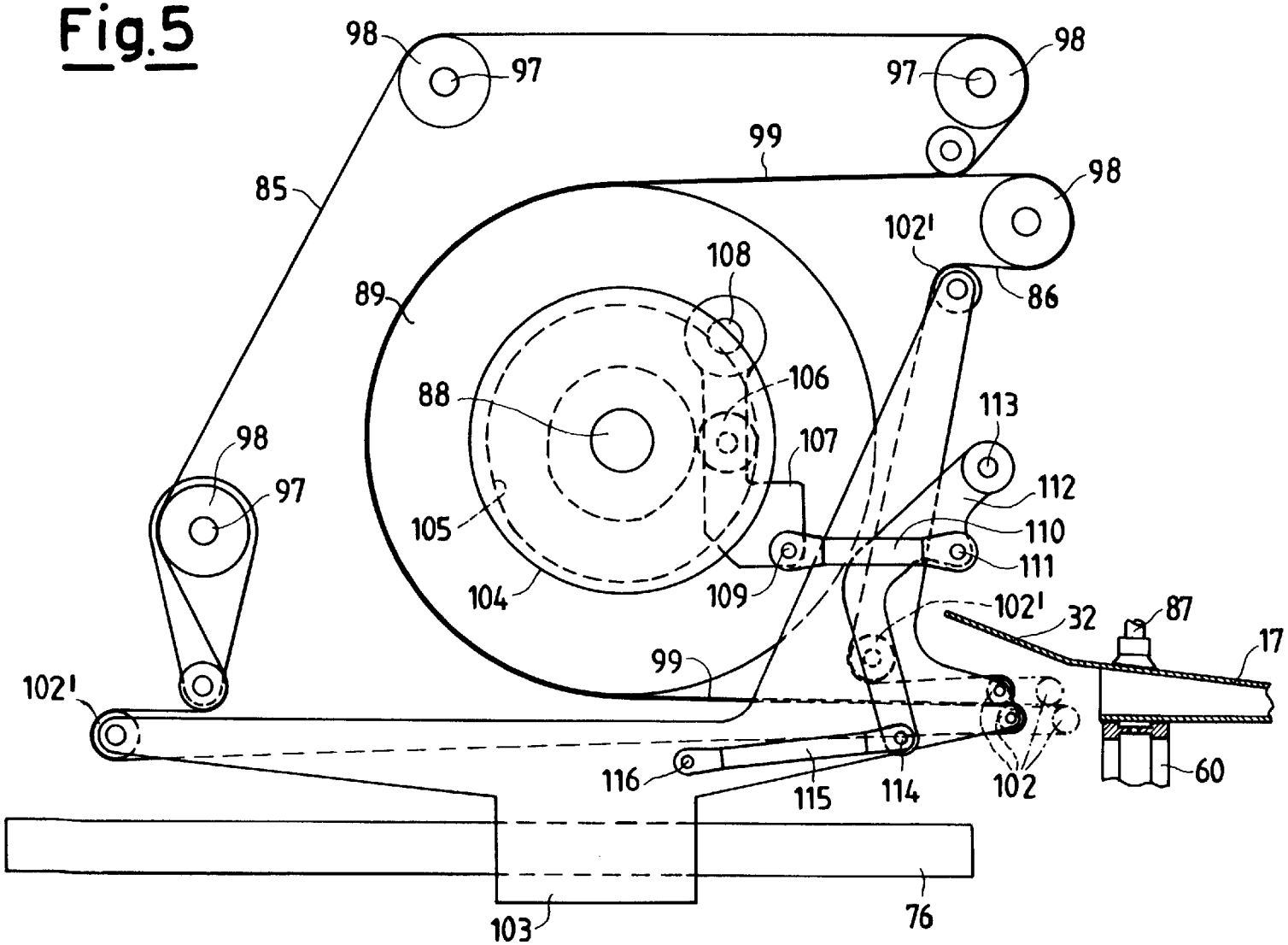
Figure 7:
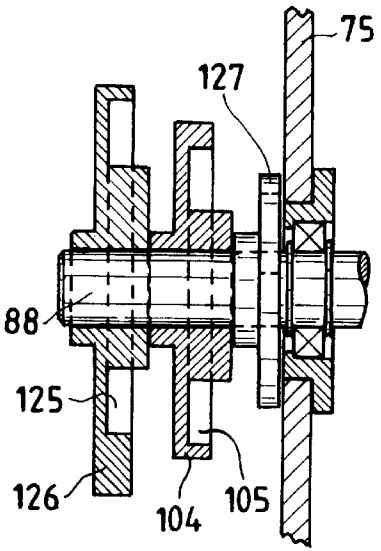
Figure 6:
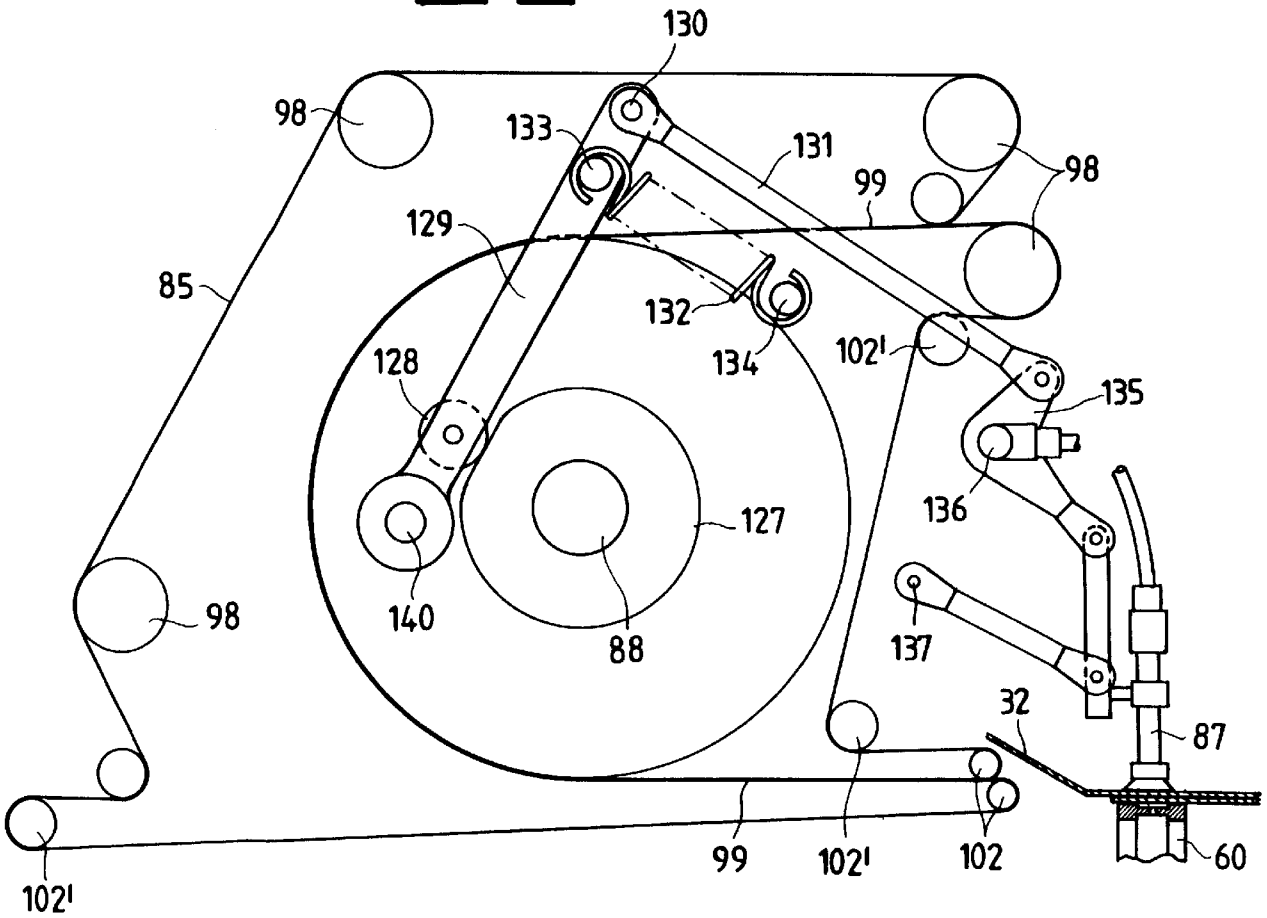
Figure 8:
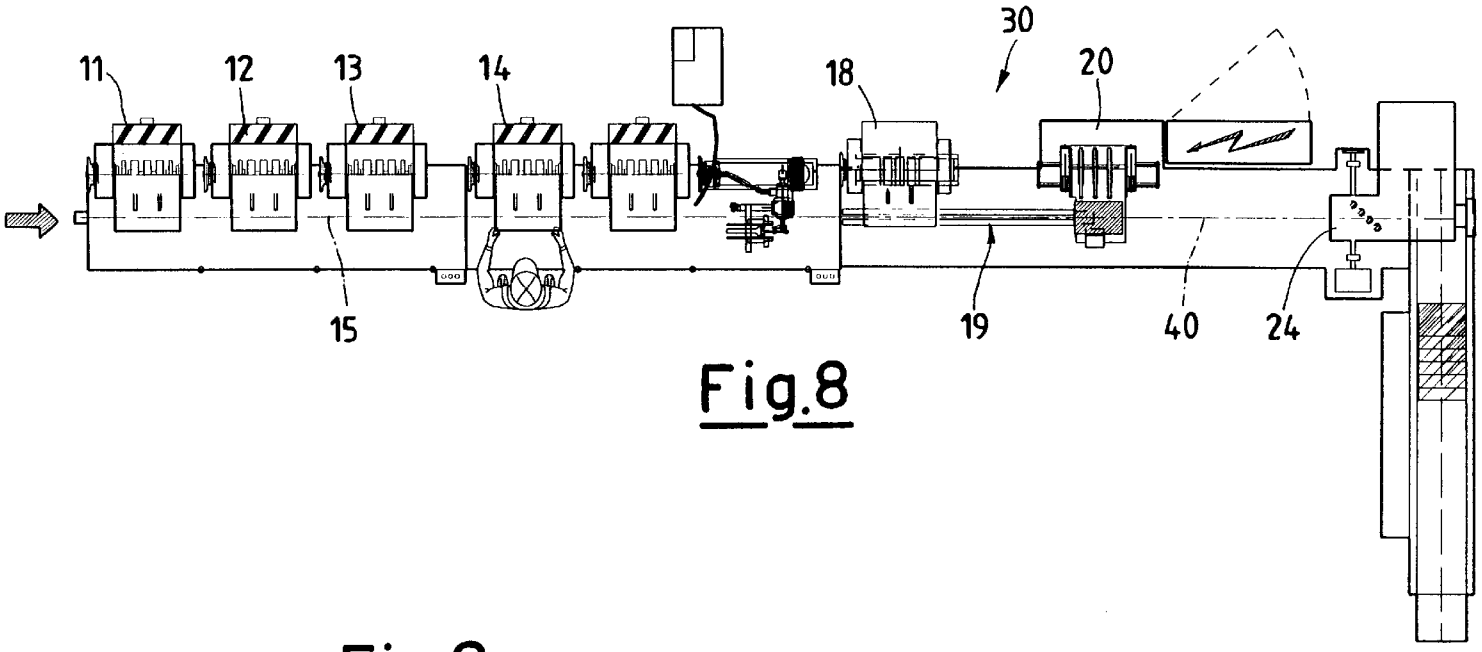
Figure 9:
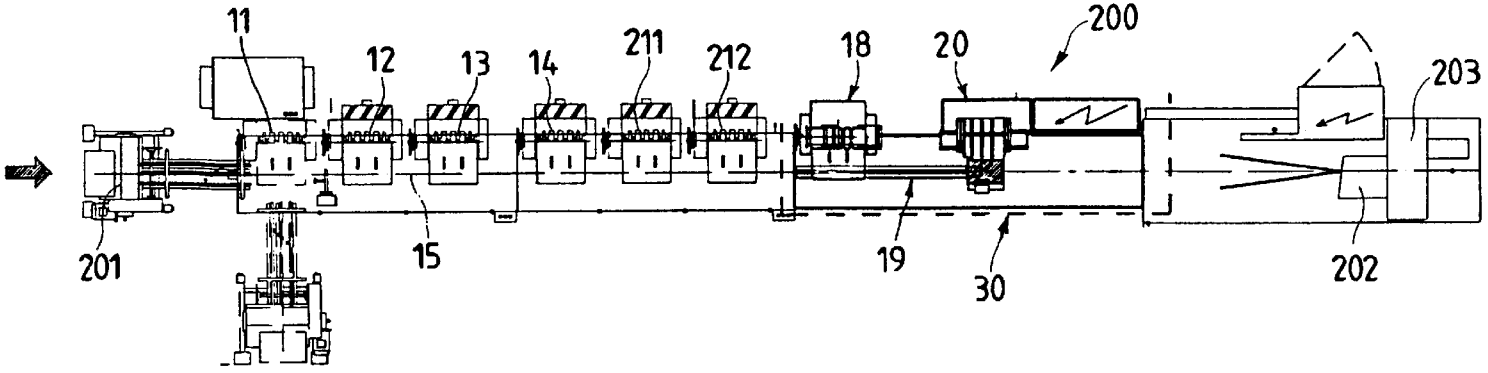
Figure 10:
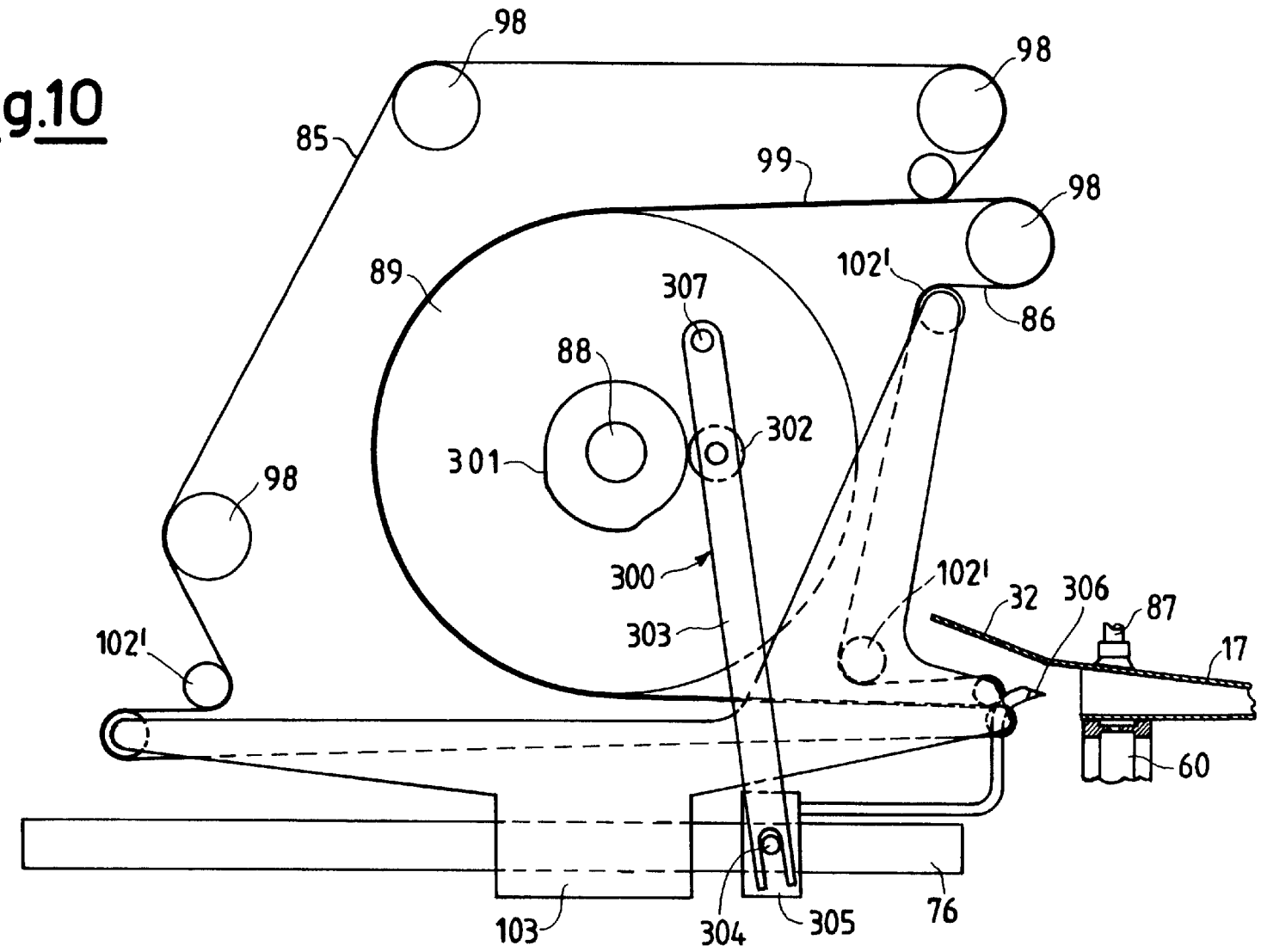
Figure 11:
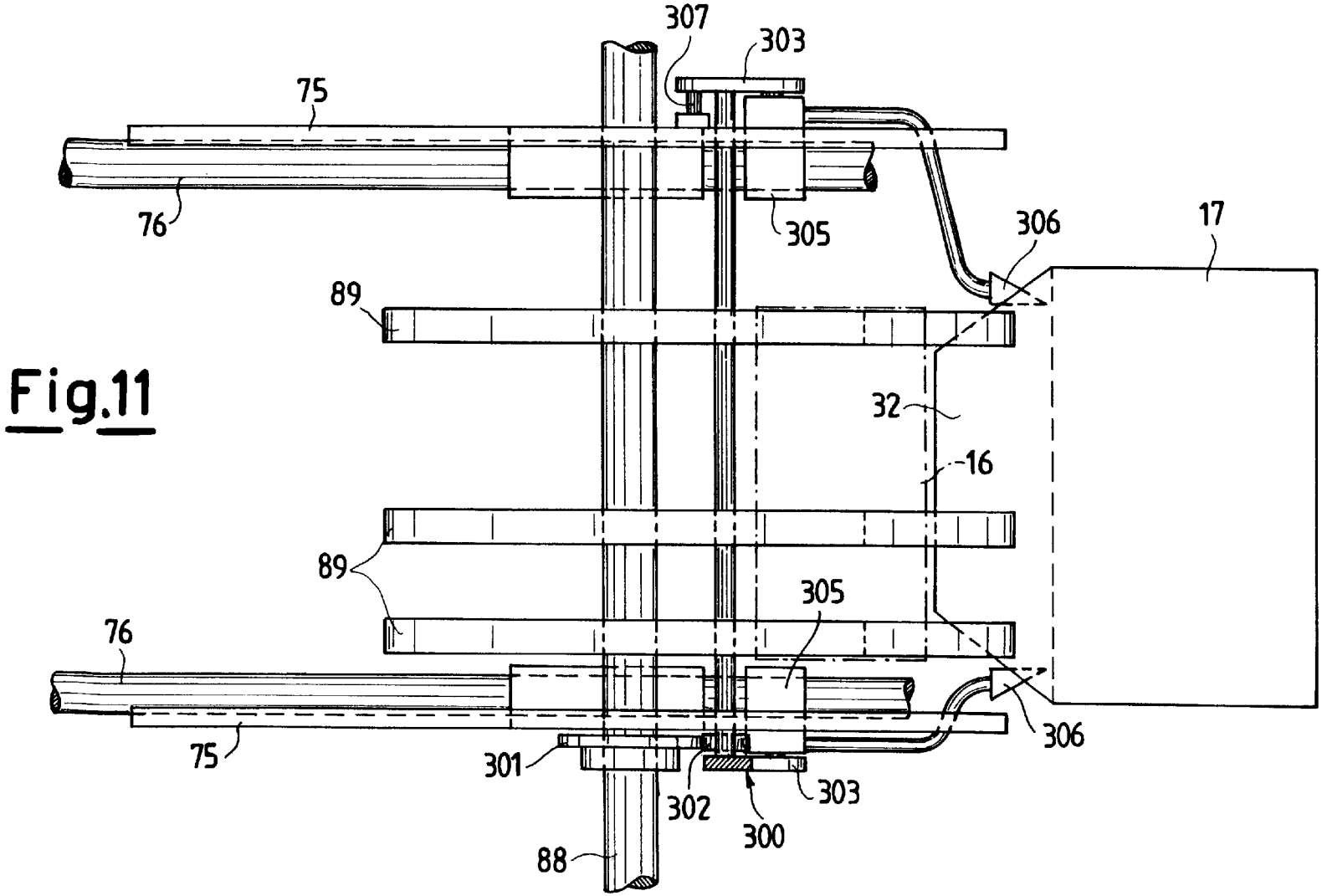
Figure 12:
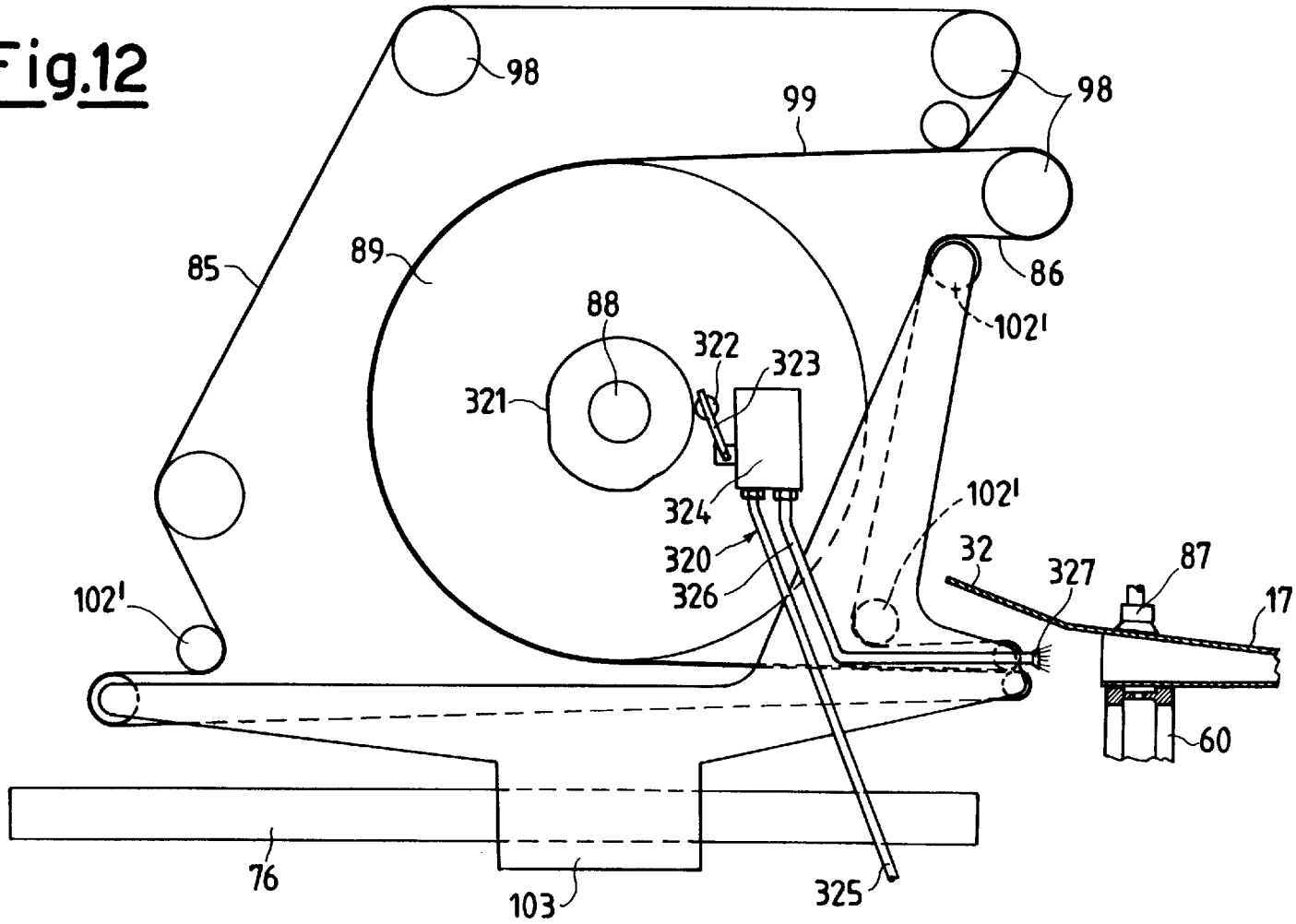
Figure 13:
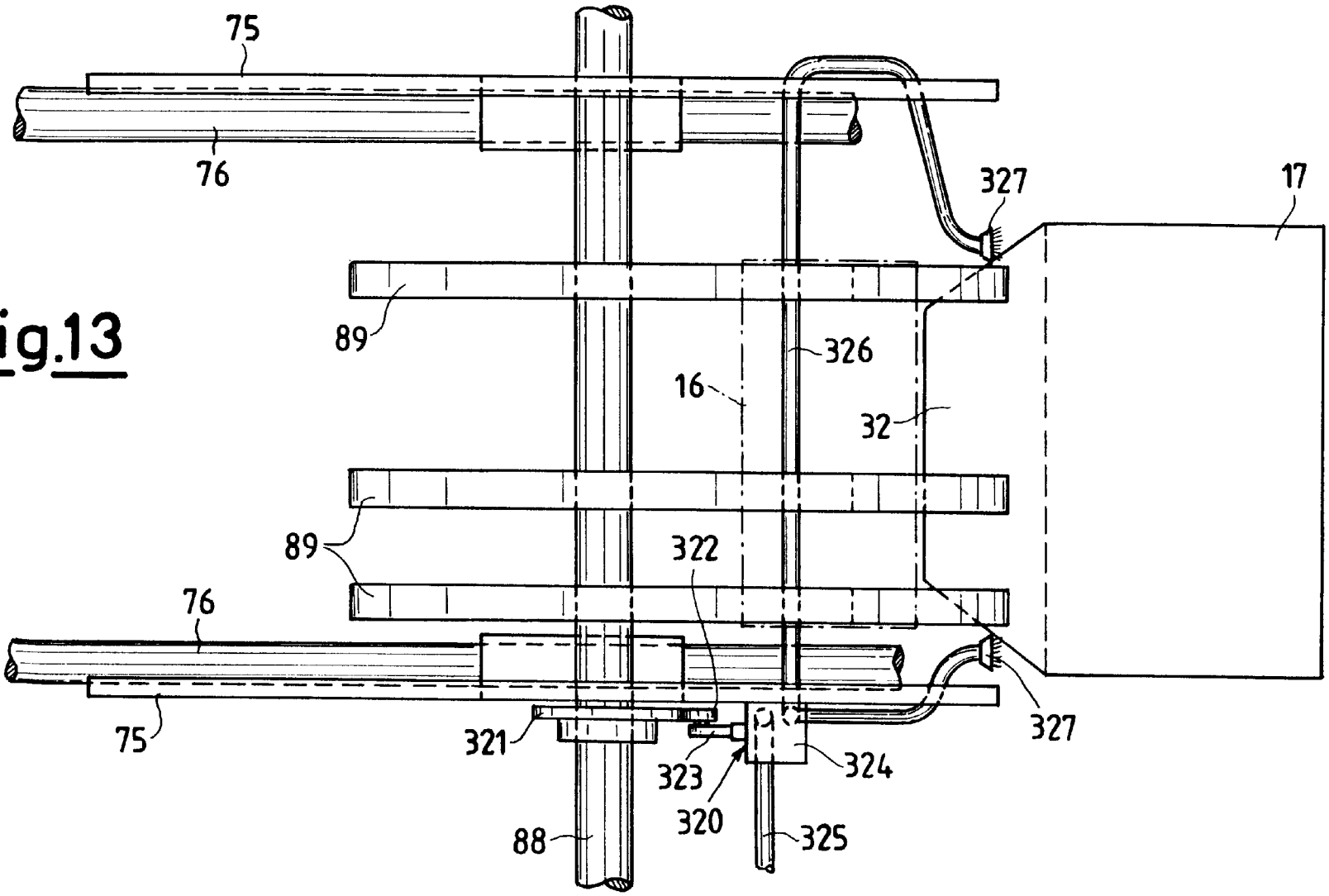
Figure 14:
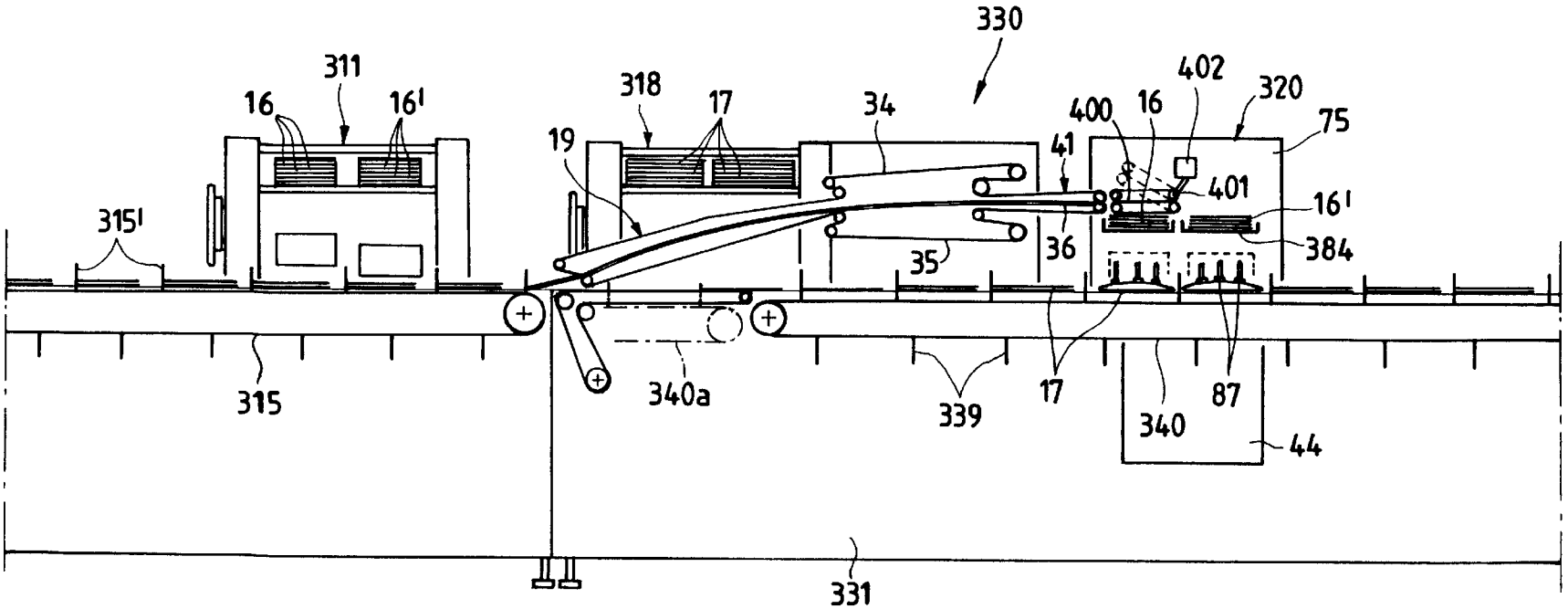

The characteristics and the advantages of a modular automatic envelope inserting machine according to the present invention are more evident from the following description of a non limiting example which refers to the attached schematic drawings, in which:

FIG. 1 is a perspective view of an operational diagram of an envelope insertion line wherein a modular automatic envelope inserting machine is placed according to the invention, FIG. 2 is a lateral elevation view of the modular automatic envelope inserting machine represented schematically, FIG. 3 is an enlarged cross-section view of a central part of the machine as in FIG. 2 wherein three cam-controlled devices are shown which cause the introduction of the inserts, the movement of the inserts towards the open envelope and the handling of the suction means utilised to open the envelope, FIG. 4 is an enlarged cross-section view that shows a cam and the relative lever mechanism for the handling of an insert pushing device in a group of belts which contribute to insert the inserts into the envelope, FIG. 5 is an enlarged cross-section view showing the group of belts accompanying said inserts, FIG. 6 is an enlarged cross-section view showing a cam and the relative lever mechanism for moving the suction means which cooperate with the opening of the envelope for the insertion of the inserts, FIG. 7 is a cross-section view of the cams which drive the devices shown in FIG. 3, FIG. 8 is a top plan view of a modular automatic envelope inserting machine similar to that schematically shown in FIG. 1, FIG. 9 is a top plan view of a modular automatic envelope inserting machine inserted in a packaging line, FIGS. 10 and 11 show an enlarged cross-section view and a top plan view of a device added to the envelope inserting machine that is used to improve and to guarantee the correct and complete opening of the envelope using shaped blade elements, FIGS. 12 and 13 show an enlarged cross-section view and a top plan view of a different device added to the envelope inserting machine, which is also used to improve and to guarantee the correct and complete opening of the envelope using air blowing elements, FIG. 14 is an elevation lateral view of a further embodiment of a modular automatic envelope inserting machine always according to a schematic representation.

FIG. 1 shows an envelope machine operation line provided with a modular automatic envelope inserting machine according to the invention and to a functional configuration or diagram which give an immediate understanding of the whole apparatus.

In fact, a series of four sheet feeders or loaders 11, 12, 13 and 14 is schematised, said feeders are placed alongside a conveyor belt 15 provided with pushing means and which advances longitudinally so as to form insert stacks or insert groups 16, 16', 16", etc. These insert groups 16, 16', 16" must be placed inside the envelopes 17 that are fed by another feeder or loader 18, placed in sequence to the four feeders 11–14. Once the stacks 16, 16', 16" are formed, said stack is directed towards a deviation device 19 that carries said stack to an insertion device 20, combined with an apparatus suitable to open the envelopes in order to insert each stack into the respective envelope 17. The insertion operation takes place without any stops since the envelope 17 and the insertion device 20 translate along a parallel direction during such operation.

Therewith, as schematised in FIG. 1, the envelope 17' containing the relative selected insert stack 16, 16', 16" is made to advance towards a dampening roll 21 and to a closing device 22 of the open flap. A telecamera 23 can also be provided upstream of the insertion line, said telecamera allows the selective choice of the inserts to be put into the envelopes, as well as a labelling machine 24, if necessary suitable for printouts, an ink jet printer 25 and other added devices. In general, it must be pointed out that a modular automatic envelope inserting machine according to the invention can be used as a single machine, as shown in FIG. 8, or it can be put in a packaging line, as shown in FIG. 9. In the not used case, the module, present in the operating line and wherein the envelope insertion is realised, can be deactivated from the main line by lifting a part of said module, and the module structure is used as a transit area of the packaging products, without the need of making any modification.

In FIG. 2, a lateral elevation view of just a modular automatic envelope inserting machine (indicated by 30) is illustrated, wherein the various groups and the respective control elements for the various functions are schematised.

Upstream of the machine 30 there is said conveyor belt 15 provided with pushing means, and said conveyor makes the insert stacks 16, 16', 16" advance towards the inlet of the deviation device 19. The machine 30 comprises a supporting structure 31 whereon the envelopes 17 are made to advance and, into said envelopes, one or more flat inserts are placed, for example print outs of various kinds to form stacks or packs 16, 16', 16". A certain number of insert feeders 11–14 (shown in FIGS. 1 and 8) are placed upstream of the supporting structure 31 in order to feed inserts towards a feed conveyor belt 15, e.g. of the type provided with pushing means.

Therewith, a feeder 18 for a single envelope 17 is provided. This feeder 18 turns the envelope 17 over from a position wherein the surface with the address faces downward to a position wherein such surface faces upward and the sealing flap 32 is open and aligned with the envelope, and elements, suitable to rotate said flap by 180° during the opening operation, are provided.

Said deviation device 19 is provided alongside the envelope feeder 18 to transport one or more inserts 16, 16', 16" selected from the various feeders 11–14 which are then unloaded onto the conveyor belt 15 in stacks.

This deviation device 19 comprises a base structure 33 that supports a structure **33*a* carrying belt couples 34, 35, positioned as a closed ring and facing each other along a containment common section 36. These belt couples 34, 35, along their common section 36, are suitable to block and to carry the inserts 16, 16', 16". The structure 33*a* carrying the belt couples 34, 35 can be lifted by means of a crank actuator 37, in the case of excluding the withdrawal of the inserts from the belts, changing the apparatus into a simple flat conveyor belt. In this case, other belts 38 are activated, and said belts are positioned at the inlet of the apparatus 30 underneath the deviation device 19** in order to re-establish the transport continuity of the products under process.

When the deviation device 19 is lowered to an operating position, it receives the insert stacks 16, 16', 16" fed by the conveyor belt 15 provided with pushing means. Simultaneously, the envelope feeder 18 feeds a single envelope on the pushing means 39 of a conveyor belt **40*a*. Then, the first section of the conveyor belt 40*a* brings the single envelopes, which are to be carried on, to a further conveyor belt 40**, provided with pushing means, which extends for almost the whole length of the apparatus.

The end portions 41 of such common section 36 of the belt couples 34, 35 are integral with a first carriage 42, which can be moved back and forth on the rods 65 integral with the structure 33. This first carriage 42 is made integral with a second carriage 44, whereto said transversal insertion device 20 is also integral, by means of tension rods 43.

The end portions 41 of the belt couples 34, 35 are mobile and can recover the belt as they run along the pulley couples 45 and 45' that are directly supported on the first carriage 42.

It has to be noted that the apparatus is driven by a motor 46 that transmits the movement through a toothed belt drive 47 to a reduction unit 47' and then to a drive shaft 48 placed longitudinally with respect to the apparatus. This drive shaft 48, by means of a chain 49 and of the relative pinion gears 50, drives the envelope feeder 18. Another pinion gear 51 placed on the shaft 48 connects said shaft, by means of a double chain 52, to a release device, indicated by 53, provided with a clutch, that through another pinion drive 54 and a chain 55 causes the rotation of a second shaft 56 parallel to the first shaft 48. The release device 53 allows the main drive shaft 48 and the second shaft 56 to be phased together. Such second shaft 56 drives a couple of pinion gears and angular transmissions 57 and 58. These couples of pinion gears and of transmissions 57 and 58 cause the rotation, by means of chains 59, of a couple of suction belts 60 and 61 which are suitable to hold the envelope 17 when it is alongside the insertion device 20 for the insertion operation and when it is in the successive dampening stage using the dampening roll 21.

Additionally, the pinion gear and the angular transmission 57 cause the dragging, by means of another chain 62, of a pulley 63 which drives the conveyor belt 40 provided with pushing means. The second angular transmission 58 drives the first section of the conveyor belt **40*a* by means of a chain control 64**.

A further motorization is placed within the supporting structure 31 and controls the movement of the insert stacks 16, 16', 16" towards their positioning inside the respective envelope 17, as well as the correct insertion of such inserts. In fact, a motor 70 is provided with a flow vectorial control inverter which operates an electric shaft through an encoder, and is provided with an angular transmission 71 which causes the rotation of two driving rubber rolls 73 of the belts 34 and 35 through a chain drive 72. The rubber rolls 73 are placed in the supporting structure 33 of the deviation device 19. Alternatively, the motor 70 could be eliminated and a transmission could be inserted to take the movement directly from the drive shaft 48 and to drive an inlet shaft of an intermediate control group, called oscillator 93, which will be disclosed hereinafter.

The insertion device 20 is substantially placed on the second carriage 44 that can be longitudinally translated, with respect to the apparatus, on guide rods 74 connected to the supporting structure 31, provided, if necessary, with axial ball bearings. Such forward and backward movement takes place in parallel to the first suction belt 60 whereupon the single envelopes 17 are placed. The carriage 44 supports a frame 75, which can transversally move with respect to the apparatus, on the columns 76, fixed to the carriage 44, i.e. perpendicularly to the forward and backward movement of the carriage 44. To such purpose, it is provided a control device 77, which can be driven through a crank 80 and which drives said frame 75, moving it closer to or away from the surface whereupon the envelopes are carried. Also the suction belt 60, which is provided with surface holes 78 positioned by the suction chamber 79 which is placed and extends underneath the upper flat portion of said suction belt, can be moved in a transversal direction with respect to the apparatus and to the envelope transport plane. This is possible by operating a drive crank 81 that causes the rotation of a worm screw 82 and the movement of a nut thread 83 that supports both the suction belt 60 and the suction chamber 79. This movement allows the suction belt 60 to work with the upper envelope in the most convenient point.

The frame 75 on the carriage 44 carries three operative groups which, by working together, cause the transfer of the single insert stack which arrives from the deviation device 19 towards the open envelope wherein the stack is inserted.

A first group comprises a pushing device 84 that transversally operates with respect to the whole apparatus and that, once the insert stack 16 is received, is operated by a cam mechanism which moves said stack towards a second group of conveyor belts 85 and 86. A third group comprises suction elements 87 that operate on the upper surface of the envelope 17, while its lower surface is locked by said suction belt 60. As it will be shown hereinafter, these three groups, according to a co-ordinate action, cause the insertion of the insert stack into the envelope, even though both the carriage 44, which carries said inserts, and the suction belt 60, which carries the envelope, move ahead longitudinally inside the apparatus.

More exactly, a rotating shaft 88 comprising flat keyed pulleys 89 is supported on the frame 75. The shaft 88 motorization is supplied by an angular transmission 90 driven by a cardanic shaft 91 combined with a suitable device 92 which allows to recover the transmission elongation, and which serves as a connecting telescope element. Also in this case, the source of this movement is the motor 70, seen heretofore, that activates the intermediate control group, called oscillator 93, wherefrom two different types of movement are generated. A rotary motion is generated from one side, as a result of the angular transmission 94 that is placed upstream of the device 92 and of the cardanic shaft 91. An intermittent alternative motion is generated from the other side of the oscillator 93 by means of an oscillating lever 95 that is connected, at its free end, to a carriage 44 by interposing an articulated lever 96. The frame 75 comprises substantially a couple of side plates that support the shaft 88 and the flat pulleys 89. The two side plates of the frame 75 further support a series of shafts 97 carrying additional pulleys 98 whereon the belts 85 and 86 are wound. These belts 85 and 86, three couples in the example, are placed as a closed ring and face each other along their common containment section 99. Such common containment section 99 has substantially an open C shape and extends from a plane 100 for receiving the insert stacks 16, underneath the pushing device 84, up to an underlying plane, indicated by 101, whereupon the envelopes are carried. The insert stack is therefore clamped inside the common section 99 and carried towards the envelope.

It has to be noted that the belts 85 and 86 also are also wound on the pulleys 102 placed at the end of an additional carriage 103. In such a way, the end portions, wherein the belt couples 85 and 86 are opposite, are mobile and can recover the belt since said ends run on a couple of pulleys 102 and 102' that are directly supported by the carriage 103. In fact, to such an end, the carriage is subjected to a small transversal movement with respect to the machine by means of a cam control mechanism. In fact, a rotating plate 104 is provided on the side of one of the frame plates 65 on a shaft 88 extension, said plate is provided with a hollow cam race 105 wherein a roll 106, supported by an intermediate portion of a lever 107, engages. One end of the lever 107 is pivoted in 108 to the frame 75 and the other end of the lever has a first end of a tension rod 110 therein pivoted in 109. The other end of the tension rod 110 is pivoted in 111 to a bell crank 112, which, at one end, is pivoted in 113 to the frame 75, while, at the other end, a tension rod 115 is therein pivoted in 114 and said rod is pivoted in 116 to the carriage 103. The rotation of the plate 104 causes, through the cam kinematic motion as described before, an alternate forth and back movement, with respect to the envelope transport area, of the lower ends of the belts 85 and 86 through the pulleys 102 placed at the front part of the carriage 103 (as shown by a chain line in FIG. 5). This further movement is actuated during the insertion of the inserts into the envelope, simultaneously to the forward movement of the carriage 44, in order to fully insert the inserts into the envelope and to release the rolls 102 from the forward moving envelope.

As said heretofore, the introduction of the insert stacks along the common section 99 of the belts 85 and 86 is caused by the pushing device 84. Such pushing device 84 is placed at the end of a couple of rods 117 which can slide on the bushes 118 fixed to the frame 75. The rods 117 are also connected, by means of an intermediate tension rod 119 having the end pivots 120 and 121, to a free end of a lever 122. The other end of said lever 122 is pivoted in 123 to the frame 75 and carries a wheel 124 in one of its intermediate areas. This wheel 124 is engaged in a hollow cam race 125 obtained on a rotating plate 126 integral to the shaft 88. Finally, the shaft 88 whereon an annular cam 127 is fixed to said shaft outer surface and said cam is driven by a roll 128 which can rotate in an intermediate area of an additional oscillating lever 129. One end of such additional lever 129 is pivoted in 140 to the supporting structure 75 while the other end has a tension rod 131 pivoted in 130 to said lever. A spiral spring 132, fixed at one end to a pivot 133 placed on said additional lever 129 and at the other end to a pivot 134 integral to the frame 75, keeps the roll 128 in contact with the outer surface of the annular cam 127.

The tension rod 131 is pivoted, at its free end, to an adjustable bell crank 135 that operates an adjustable four-bar linkage, which is pivoted in 136 and in 137 to the frame and which supports the suction elements in the shape of suction cups 87 whereto suction pipes are connected.

FIG. 7 shows a cross-section view of the side by side configuration of the control cams of the three previously described groups which constitute the insertion device of the inserts into the envelopes and which are placed alongside one of the plates forming the frame 75.

Therefore, it is evident how this apparatus, according to the present invention, can be driven by different sources of movement. In particular the motor 46 and the reduction unit 47' could be omitted when the apparatus is inserted into a packaging line. In fact, in such a case the rotation control of the control shaft 48 could arrive directly from the packaging line drive.

A brief explanation is given herein in order to better understand how the envelope inserting machine works.

As shown in FIG. 1, the selection of the inserts to be inserted into a single envelope 17 is provided by means of a suitable programming. Alternatively, the telecamera 23 reads an address or another identification element present on the first insert fed by the first feeder 11 and then causes selection of further inserts to be added to the first insert, before the insertion into the envelope. As a result, insert stacks 16, 16', 16" are formed, to be inserted inside the envelopes 17. The insert stacks, during formation, are made to advance by the conveyor belt 15 provided with pushing means, until said stacks are received by the deviation device 19 between the belts 34 and 35 along the common section 36 where said belts face each other. Then the stacks advance towards the end portions 41 of the belt couples 34 and 35 and are unloaded onto the receiving surface 100. Simultaneously, the feeder 18 feeds an envelope 17 to a section 40*a* of the conveyor belt provided with pushing means so that the envelope is made to advance to the first suction belt 60 which is positioned side by side to the insertion device 20. As said before, the envelope 17 advances with its sealing flap 32 open and the address or address window facing up. Once the insert stack 16 is received on the receiving surface 100, it is then moved by the pushing device 84 between the belts 85 and 86 at the beginning of their common section 99 where said belts face each other. Therefore the driven descent of the insert stack 16 starts inside the C shaped common section towards the end portion of the belts which is placed on the carriage 103 that can be moved closer to the surface 101 whereon the envelopes are carried. Simultaneously, the envelope is held on its lower surface by the suction belt 60 while the annular cam 127 causes the suction cups 87 to move towards the upper surface of the envelope. The suction cups engage such surfaces and cause the lifting of said surface and the opening of the envelope.

The end portion of the belts 85 and 86 moves closer to the envelope by means of the carriage 103, introduces the insert stack 16 into the opening of the envelope and then goes quickly back. The suction cups are deactivated and removed through the rotation of the cam control and the envelope is then made to advance with its contents whilst being held just by the suction belt 60. Anyhow, the forward movement is assisted by the presence of pushing means 39 of the conveyor belt 40. The envelope then arrives at the second suction belt 61, that has the same structure as the first, wherein a dampening roll 21 can be provided as well as the closing device 22 of the open sealing flap, so as to close the envelope.

Throughout these stages, the envelope, fed by the relative feeder 18, continues its run on the horizontal conveyor belt provided with pushing means or on other areas, such as suction belts, that guarantee the continuity of the surface whereon the envelopes are carried. In parallel and with a co-ordinated movement, the insert stacks are selected and transported to the insertion device and inserted into the relative envelope 17.

It is important to point out the particular configuration of the three cam driven groups on the carriage 44 whereon the insertion device 20 is placed. The cams 105, 125 and 127 have to be synchronised in such a way that the pushing means 84 can direct the stack 16 within belts 85 and 86 in time to be aligned with the envelope 17 moving on said sliding and carrying surface 101. Furthermore, the return of the pushing device has to be swift so as to receive a successive stack from the deviation device 19. Similarly, the movement of the lower end of the common section 99 of he belts 85 and 86 has to be such to allow an easy insertion of the stack into the envelope and the release of the envelope. Even earlier, the descent of the suction elements on the upper surface of the envelope has to be co-ordinated, as well as the suction phase of the suction cups, i.e. the clamping, the opening and the release of said envelope. Preferably, this cycle has a duration equal to the onward run of the carriage 44.

FIG. 8 shows a top plan view of the embodiment of an envelope inserting machine previously schematised in FIG. 1, which is autonomous and is provided with feeders only intended therefor.

FIG. 9 shows a top plan view of a configuration wherein an envelope inserting machine according to the present invention can be inserted in a packaging line 200 without carrying out any modifications, using the feeder and other auxiliary devices that are already provided in the line. This is possible by the fact that the inserts and the envelope are made to advance along a central channel which is also used for packaging. Therefore lateral deviations of the envelope or of the inserts present in the known envelope inserting machine are eliminated.

Such line 200 can comprise a frontal feeder 201, a series of sheet feeders 11, 12, 13, 14, 211, 212 as well as a transport surface that provides a conveyor belt 15 provided with pushing means.

Then, the previously described modular envelope inserting machine 30 is inserted and is placed in front of the following longitudinal 202 and transversal 203 connecting groups.

Should it be necessary to use the packaging line 200 and not to use the envelope inserting machine, it would be sufficient to operate with the crank actuator 37, so as to lift the deviation device 19 and thus disconnecting the envelope feeder 18. Operating on the crank actuator 37 causes the rotation of a structure 33*a* supporting the belts 34 and 35 and which can oscillate around an axis 33*b* with respect to the base structure 33. In this case the envelope inserting machine would be solely used as the carrying surface of the materials to be packed or being packed.

If other modules are placed after the envelope inserting machine, other inserts could be added to an already prepared envelope and then a packaging could be provided.

Moreover, for particular types of envelopes that have a greater resistance during the opening as a result of glued areas or of areas which tend to glue together, additional devices could be provided that help the opening of the envelope before the insertion phase of the inserts 16, 16', 16", etc.

FIGS. 10 and 11 show, as said before, an enlarged cross-section view and a top plan view wherein a first type of an additional device can be added to the envelope inserting machine, indicated by 300, and can be placed on the insertion device 20.

Such device 300 is placed on the shaft 88, for instance before the annular cam 127, and provides a further annular cam 301 whereon a roll 302 rotates, said roll is integral with an intermediate portion of an oscillating lever 303, pivoted in 307, at one of the lever ends, to the frame 75. The other end of the lever 303 engages into a slot with a pivot 304 of a carriage 305 that can slide back and forth on the columns 76.

Such carriage 305 has a couple of shaped blade elements 306 placed at opposite sides with respect to the insertion device 20, i.e. near the end of an envelope 17 that advances alongside the device 20. Said shaped blade elements 306 penetrate into the opening of the envelope 17 just before the insertion of the inserts 16, 16', 16" takes place and while the shaft 88 is rotating. The entry of said blade elements 306 guarantees the separation of the upper portion from the lower portion of the envelope just near the opposite extremities of the opening. Moreover, the particular triangular shape that diverges towards the outer portion of the blade element 306, improves the opening of the envelope by penetrating into the envelope. Immediately after or almost simultaneously, the insertion of the insert stacks 16, 16', 16" takes place, avoiding every possible sticking caused by an incomplete opening of the envelope.

FIGS. 12 and 13 show an enlarged cross-section view and a top plan view of a second type of an additional device which can be provided to the envelope inserting machine, indicated by 320, and which can also be used to improve and guarantee the correct and complete opening of the envelope.

Said second device 320 provides a further annular cam 321 on the shaft 88 whereon a roll 322 rotates said roll is integral with an oscillating lever 323 of a pneumatic valve 324. Such valve 324 does or does not connect an air feeder pipe 325 to an air emission pipe 326 provided with elements that blow air or with air emission nozzles 327.

These elements that blow air or air emission nozzles 327 are placed on opposite sides with respect to the insertion device 20, i.e. near the end of an envelope 17 that advances alongside said device 20.

Their activation by means of the valve 324 which is driven by the cam 321 causes a release of air inside the opening of the envelope 17 near the opposite ends of the opening, thus allowing a safe separation of the upper portion from the lower one, before the inserts arrival, even in those end areas where problems could arise.

Therefore, also said additional devices contribute to the proper operation of the entire envelope inserting machine of the present invention.

FIG. 14 shows a second embodiment of an automatic envelope inserting machine, provided with a high productivity level and indicated schematically by 330, whereby the handling and the filling of pairs of envelopes with inserts is realised.

This apparatus can be inserted into a packaging line without the need of any modification thereof, by using the feeder and other auxiliary devices already present in the line or by providing its own feeders and by working just as an envelope inserting machine. In fact, in both cases, the inserts and the envelopes are made to advance along a central channel that, in a packaging machine, is also used for the packaging.

The envelope inserting machine 330 comprises, as shown in the example of FIG. 14, a supporting structure 331 whereon at least one insert loader 311 and one envelope feeder 318 are placed. The insert loader 311 feeds couples of flat inserts 16 and 16' towards a conveyor belt 315, while the envelope feeder 318 feeds couples of envelopes 17 towards a conveyor belt 340*a*, 340 realised in two sections for the entire length of the machine. Both the couples of inserts 16, 16' and the couples of envelopes 17 are aligned in a longitudinal direction with respect to the machine and are spaced by a minimum distance. On the other hand, there can be two insert loaders 11, 12, etc. that are close to each other and that properly feed inserts towards the conveyor belt 315. In fact, the pushing elements 315' and 339 of the various conveyor belts 315, 340*a* and 340 are placed at a distance slightly larger than that of an envelope 17, for instance in the format known as "C5" or as "C6/C5", according to a first characteristic of the alternative embodiment of the present invention, in order to make the machine extremely fast and to increase its productivity.

A deviation device 19 is placed before the envelope feeder 318 in order to carry the couples of inserts 16 and 16', one after the other, towards an insertion device 320. As already disclosed by the previous embodiment, said insertion device 320 can be moved back and forth with respect to the supporting structure 331 by means of suitable translation elements (not shown in the figure), in a direction parallel to the feeder conveyor belt 340, 340*a* and synchronised with the feeding of the couples of envelopes 17.

It should be noted that, at one end of the deviation device 19 for carrying the couples of inserts 16, 16', a pushing device (not shown in the figure) is provided in order to cause the movement of said couple of inserts from the deviation device to the insertion device 320. Moreover, a belt 400 is placed on a frame 75 of a carriage 44 that supports the insertion device 320, such belt is aligned to the end portions 41 of the couples of belts 34, 35 that form the deviation device 19. Naturally, the carriage 44 can be longitudinally translated towards the apparatus, as previously described for the first embodiment. Such back and forth translation takes place in a direction parallel to a suction belt (not shown in the drawing) whereon the envelopes 17 arrive.

The frame 75 on the carriage 44 supports substantially three working groups that determine the transfer of the two couples or stacks of inserts 16, 16' placed side by side which arrive from the deviation device 19 towards the opening of the two envelopes for the insertion stage.

Said belt 400 is placed above the pushing group, schematised in 384, that operates transversally with respect to the entire apparatus, and said belt can be rotated around a pivot 401 between a position aligned with the end portions 41 of the belt couples 34, 35 and a position overturned with respect to said end portions, by means of a mechanical or pneumatic actuator, schematised in 402. Such actuator can move the belt 400 upwards or downwards in the space that lies between the first and the second insert or groups of inserts 16, 16'. As a result the second insert or group of inserts 16, 16' falls below the belt 400.

The following inserts 16 and 16' are placed in two different positions on the pushing device group 384, that transversally operates to put said inserts on the belts (not shown) which belong to the conveyor group which carries the inserts towards the opening of the underlying envelopes 17. In the meantime, these envelopes 17 have been opened by the coordinated action of the above mentioned suction belt, and of the suction cup elements 87 which also belong to the insertion device 320.

As a result, a double and simultaneous insertion of inserts, groups of inserts or alike into two envelopes, which are carried on the conveyor belt 340 with pushing means 339 placed at short intervals, is realised.

Even though the apparatus shown in FIG. 14 generally works like the device previously described for the first embodiment, said apparatus is faster and has a double productivity level.

Also in this case, the automatic envelope inserting machine with a high productivity level, according to the present invention, can be inserted into a packaging machine. In such case, the belts 38 re-establish the continuity of the carrying operation of the products, if the apparatus is only being used as a packaging machine. Moreover, the feeders or loaders of the packaging machine can be utilised.

What is claimed is:

1. An envelope inserting machine comprising:

a supporting structure on which envelopes are made to advance, at least one insert being configured to be inserted into each of the envelopes;

an envelope feeder configured to feed the envelopes towards a conveyor belt which carries the envelopes;

at least one insert loader configured to supply the at least one insert to the conveyor belt;

opening elements configured to open the envelopes on the conveyor belt;

an insertion device which is configured to insert the at least one insert into each of the envelopes on the conveyor belt, said insertion device including suction elements as additional opening elements of said envelope, said suction elements being controlled by an oscillating lever engaged with an annular cam through an elastic element, said suction elements being driven by a four-bar linkage placed between said oscillating lever and said suction elements;

translation elements configured to move said insertion device back and forth in a direction parallel to said conveyor belt synchronizing with a forward movement of the envelopes on the conveyor belt; and a deviation device provided to carry the at least one insert from the conveyor belt towards the insertion device before the envelope feeder, the deviation device including a pushing device provided at one end of said deviation device in order to carry the at least one insert to said insertion device.

2. An envelope inserting machine comprising:

a supporting structure on which envelopes are made to advance, at least one insert being configured to be inserted into each of the envelopes;

an envelope feeder configured to feed the envelopes towards a conveyor belt which carries the envelopes;

at least one insert loader configured to supply the at least one insert to the conveyor belt;

opening elements configured to open the envelopes on the conveyor belt;

an insertion device which is configured to insert the at least one insert into each of the envelopes on the conveyor belt;

translation elements configured to move said insertion device back and forth in a direction parallel to said conveyor belt synchronizing with a forward movement of the envelopes on the conveyor belt; and a deviation device provided to carry the at least one insert from the conveyor belt towards the insertion device before the envelope feeder, the deviation device including a pushing device provided at one end of said deviation device in order to carry the at least one insert to said insertion device, wherein the insertion device is configured to be moved by means of a motor that activates an intermediate oscillating control group from which two transmissions depart, one of said transmissions is a rotating movement transmission for a shaft which is placed in said insertion device with interposed angular transmissions, and another of said transmissions is an intermittent alternate movement transmission, driven by means of an oscillating lever connected, at one of its free ends, to a carriage which supports said insertion device.

3. An envelope inserting machine comprising:

a supporting structure on which envelopes are made to advance, at least one insert being configured to be inserted into each of the envelopes;

an envelope feeder configured to feed the envelopes towards a conveyor belt which carries the envelopes;

at least one insert loader configured to supply the at least one insert to the conveyor belt;

opening elements configured to open the envelopes on the conveyor belt;

an insertion device which is configured to insert the at least one insert into each of the envelopes on the conveyor belt;

translation elements configured to move said insertion device back and forth in a direction parallel to said conveyor belt synchronizing with a forward movement of the envelopes on the conveyor belt; and a deviation device provided to carry the at least one insert from the conveyor belt towards the insertion device before the envelope feeder, the deviation device including a pushing device provided at one end of said deviation device in order to carry the at least one insert to said insertion device, wherein the insertion device is configured to be moved through a transmission which takes a movement directly from a longitudinal drive shaft which controls the machine, and which also drives an inlet shaft which belongs to an intermediate oscillation control group, from which two transmissions depart, one of the two transmissions is a rotating movement transmission for a shaft which is placed in said insertion device with angular transmission, and another of the two transmissions is an intermittent alternate movement transmission driven by means of an oscillating lever connected, at one of its free ends, to a carriage which supports said insertion device.

4. An envelope inserting machine comprising:

a supporting structure on which envelopes are made to advance, at least one insert being configured to be inserted into each of the envelopes;

an envelope feeder configured to feed the envelopes towards a conveyor belt which carries the envelopes;

at least one insert loader configured to supply the at least one insert to the conveyor belt;

opening elements configured to open the envelopes on the conveyor belt;

an insertion device which is configured to insert the at least one insert into each of the envelopes on the conveyor belt;

translation elements configured to move said insertion device back and forth in a direction parallel to said conveyor belt synchronizing with a forward movement of the envelopes on the conveyor belt; and a deviation device provided to carry the at least one insert from the conveyor belt towards the insertion device before the envelope feeder, the deviation device including a pushing device provided at one end of said deviation device in order to carry the at least one insert to said insertion device, wherein said deviation device comprises a base structure which supports couples of belts on an additional structure, the couples of belts are placed in the shape of a closed ring and face each other along a common holding section which is configured to block and carry said at least one insert, and said base structure which supports said couples of belts is configured to be lifted by means of an actuator to avoid a drawing of said at least one insert by said belts.

5. An envelope inserting machine comprising:

a supporting structure on which envelopes are made to advance, at least one insert being configured to be inserted into each of the envelopes;

an envelope feeder configured to feed the envelopes towards a conveyor belt which carries the envelopes;

at least one insert loader configured to supply the at least one insert to the conveyor belt;

opening elements configured to open the envelopes on the conveyor belt;

an insertion device which is configured to insert the at least one insert into each of the envelopes on the conveyor belt;

translation elements configured to move said insertion device back and forth in a direction parallel to said conveyor belt synchronizing with a forward movement of the envelopes on the conveyor belt; and a deviation device provided to carry the at least one insert from the conveyor belt towards the insertion device before the envelope feeder, the deviation device including a pushing device provided at one end of said deviation device in order to carry the at least one insert to said insertion device, wherein a motor is provided which transmits a movement by means of a toothed belt transmission to a reduction unit connected to a drive shaft placed longitudinally with respect to said machine, a drive shaft drives said envelope feeder by means of a chain transmission, an additional transmission is provided towards a release device which, through an additional chain transmission, causes a rotation of a second shaft parallel to said first shaft and which drives other devices, said release device allows synchronizing between said main drive shaft and said second shaft, said second shaft drives the rotation of a couple of suction belts which can hold said envelopes both when facing the insertion device in order to receive inserts and in the following dampening stage by means of a dampening roll.

6. An envelope inserting machine comprising:

a supporting structure on which envelopes are made to advance, at least one insert being configured to be inserted into each of the envelopes;

an envelope feeder configured to feed the envelopes towards a conveyor belt which carries the envelopes;

at least one insert loader configured to supply the at least one insert to the conveyor belt;

opening elements configured to open the envelopes on the conveyor belt;

an insertion device which is configured to insert the at least one insert into each of the envelopes on the conveyor belt;

translation elements configured to move said insertion device back and forth in a direction parallel to said conveyor belt synchronizing with a forward movement of the envelopes on the conveyor belt; and a deviation device provided to carry the at least one insert from the conveyor belt towards the insertion device before the envelope feeder, the deviation device including a pushing device provided at one end of said deviation device in order to carry the at least one insert to said insertion device, wherein a device is combined with said insertion device in order to help to open said envelopes, said device comprises an annular cam which is placed on a shaft belonging to said insertion device, whereby said shaft collaborates with a pneumatic valve that selectively sends air towards a couple of air blowing elements, which face said envelopes at the opposite ends of said envelope, inside its opening.

7. An envelope inserting machine comprising:

a supporting structure on which envelopes are made to advance, at least one insert being configured to be inserted into each of the envelopes;

an envelope feeder configured to feed the envelopes towards a conveyor belt which carries the envelopes;

at least one insert loader configured to supply the at least one insert to the conveyor belt;

opening elements configured to open the envelopes on the conveyor belt;

an insertion device which is configured to insert the at least one insert into each of the envelopes on the conveyor belt;

translation elements configured to move said insertion device back and forth in a direction parallel to said conveyor belt synchronizing with a forward movement of the envelopes on the conveyor belt; and a deviation device provided to carry the at least one insert from the conveyor belt towards the insertion device before the envelope feeder, the deviation device including a pushing device provided at one end of said deviation device in order to carry the at least one insert to said insertion device, wherein said conveyor belt has pushing means placed at distances a little longer than a length of an envelope, said at least one insert loader and said envelope feeder feed two inserts and two envelopes longitudinally aligned with respect to the machine and spaced so as to be placed between said pushing means, and a conveyor belt is placed at one end of said deviation device, said conveyor belt is configured to be rotated between an aligned position and an overturned position so as to cause a longitudinally spaced positioning of subsequent two inserts on said pushing means of the conveyor.

8. A machine as claimed in claim 7, wherein said conveyor belt comprises a belt that is configured to rotate around a pivot between said aligned position aligned to end portions of couples of belts which belong to said deviation device and said overturned position.

9. A machine as claimed in claim 7, wherein the movement between said aligned position and said overturned position is controlled by an actuator.

* * * * *

UNITED STATES PATENT AND TRADEMARK OFFICE

CERTIFICATE OF CORRECTION

PATENT NO. : 6,155,031
DATED : December 5, 2000
INVENTOR(S) : Aris Ballestrazzi, et al.

It is certified that error appears in the above-identified patent and that said Letters Patent is hereby corrected as shown below:

Title page,
Item [30], the Foreign Application Priority Data is listed incorrectly. Item [30] should read as follows:

-- [30] Foreign Application Priority Data

| | | | |
|---|---|---|---|
| Mar. 24, 1998 | [IT] | Italy | MI98A 000596 |
| Apr. 16, 1998 | [IT] | Italy | MI98U 000271 |

Signed and Sealed this

Twenty-third Day of October, 2001

*Attest:*

Nicholas P. Godici

*Attesting Officer*

NICHOLAS P. GODICI
*Acting Director of the United States Patent and Trademark Office*